US005165482A

United States Patent [19]

Smagac et al.

[11] Patent Number: 5,165,482

[45] Date of Patent: Nov. 24, 1992

[54] FIRE DETERRENT SYSTEM FOR STRUCTURES IN A WILDFIRE HAZARD AREA

[76] Inventors: Dennis E. Smagac, 7482 Marshall Dr., Louisville, Colo. 80027; John D. Breedlove, 1126 James Canyon Dr., Boulder, Colo. 80302

[21] Appl. No.: 715,370

[22] Filed: Jun. 10, 1991

[51] Int. Cl.[5] ..... A62C 3/02

[52] U.S. Cl. ..... 169/45; 169/56; 169/13; 169/16

[58] Field of Search ..... 169/45, 56, 5, 7, 13, 169/16

[56] References Cited

U.S. PATENT DOCUMENTS

| | | | |
|---|---|---|---|
| 1,620,142 | 3/1927 | Thompson . | |
| 3,179,181 | 4/1965 | Banzato . | |
| 3,576,212 | 4/1971 | Siler | 169/16 X |
| 3,583,490 | 6/1971 | McFadden | 169/2 |
| 3,993,139 | 11/1976 | Vaughn | 169/62 |
| 4,091,876 | 5/1978 | Valdatta | 169/62 |
| 4,175,703 | 11/1979 | Valiant | 169/16 X |
| 4,330,040 | 5/1982 | Ence et al. | 169/13 |
| 4,428,434 | 1/1984 | Gelaude | 169/13 |
| 4,453,155 | 6/1984 | Cooper | 340/289 |
| 4,836,290 | 6/1989 | Le Lande, Jr. | 169/46 |
| 4,936,388 | 6/1990 | Le Lande, Jr. | 169/46 |
| 5,083,618 | 1/1992 | Hayes | 169/16 X |

FOREIGN PATENT DOCUMENTS

| | | | |
|---|---|---|---|
| 2603194 | 3/1988 | France | 169/13 |
| 2615110 | 11/1988 | France | 169/13 |

OTHER PUBLICATIONS

National Fire Protection Association; "Black Tiger Fire Case Study".

*Primary Examiner*—Margaret A. Focarino
*Assistant Examiner*—Gary C. Hoge
*Attorney, Agent, or Firm*—James M. Graziano

[57] ABSTRACT

The fire deterrent system operates in a preemptive manner by detecting the impending approach of a wildfire within the vicinity of the structure to be protected. The system includes apparatus to identify the locus and direction of spread of a fire while it is outside of a defensive perimeter that encircles the structure and extends outward therefrom. The estimated time of arrival of the fire at the defensive perimeter is determined and the structure and surrounding vegetation sprayed a predetermined time in advance of the determined arrival of the fire. Prewetting the structure and surrounding vegetation reduces the probability of local fires caused by wind-borne embers and reduces the combustibility of these materials to assist conventional fire fighting efforts.

44 Claims, 5 Drawing Sheets

FIG. I.

FIRE DETERRENT SYSTEM FOR STRUCTURES IN A WILDFIRE HAZARD AREA

FIELD OF THE INVENTION

This application relates to fire deterrent systems and, in particular, to a computer based system that provides preemptive protection for structures that are in impending danger from an approaching fire when these structures are located in a wildfire zone.

PROBLEM

It is a problem for rural homeowners to protect their property from the danger of wildfires. There is an increasing trend for people to build their homes in locations that are within what is called the wildland/urban interface. This is a term that describes the border zone where structures, mainly residences, are built in wildland areas that by nature are subject to fires. The wildland/urban interface describes the geographical areas where formerly urban structures, mainly residences, are built in close proximity to flammable fuels naturally found in wildland areas, including forests, prairies, hillsides and valleys. To the resident, the forest represents a beautiful environment but to a fire the forest represents a tremendous source of fuel. Areas that are popular wildland/urban interfaces are the California coastal and mountain areas and the mountainous areas in Colorado (among others).

Residences built in these areas tend to be placed in locations that contain significant quantities of combustible vegetation and the structures themselves have combustible exterior walls and many have untreated wood roofs. Many of these houses are also built on sloping hillsides to obtain scenic views; however, slopes create natural wind flows that increase the spread of a wildfire. These homes are also located a great distance away from fire protection equipment and typically have a limited water supply, such as a residential well with a minimal water flow in the range of one to three gallons per minute.

Given this collection of factors, a wildfire entering this area is very difficult to control. Wildfire can reach an intensity that causes uncontrollable and rapid spread due to spotting, which occurs as wind-borne burning embers are carried far ahead of the main fire front and land in receptive fuels. These embers can fall on the roofs of houses, on woodpiles or can start new fires in the vegetation surrounding a structure while firefighters are occupied elsewhere with the main fire.

All prior art residential firefighting systems are grossly inadequate to deal with wildfires in the wildland/urban interface area. One of the most significant failings of all of these prior art fire fighting systems is that they are reactive by nature and serve to attempt to extinguish a fire that has begun on the roof of a structure. Due to the limited supply of water in the homes in a wildland/urban interface, such a method of defense is impractical as it can deliver a very limited amount of water to the structure that is ablaze. In addition, the intensity of a wildfire quickly overwhelms these limited fire extinguishing measures since they are activated once the structure is on fire and/or the wildfire has reached the structure. Nine of these prior art systems operate in a preemptive manner nor provide any environmental dependent measures to prevent the initiation of the fire or to thwart its spread.

Therefore, there presently exists no viable fire control system for residences in the wildland/urban interface and the magnitude and number of losses due to wildfires in these areas continue to increase at a significant rate on a yearly basis. There is a critical need for a fire prevention system that operates in a preemptive manner to effectively prevent the ignition and spread of fires that occur in these wildland/urban interface areas.

SOLUTION

The above described problems are solved and a technical advance achieved in the field by the fire deterrent system of the present invention. This fire deterrent system operates in a proactive manner by detecting the impending approach of a wildfire within the vicinity of the structure to be protected. This system includes apparatus to identify the locus, magnitude and direction of spread of a fire while it is still outside of a defensive perimeter that encircles the residence and extends outward therefrom. The impending arrival of a wildfire is sensed by this apparatus and defensive measures are taken in a preemptive manner in order to prevent the ignition of a fire within this defensive perimeter rather than attempting to extinguish fires once they have already ignited, which as experience shows is a futile measure in a wildfire. This apparatus includes an infrared, ultraviolet or electro-optical fire detector to detect the presence of a fire in the immediate vicinity of the residence. The apparatus further includes an anemometer to measure the wind magnitude and direction at the home site as well as a plurality of sensors sited at various locations around the defensive perimeter to detect the ignition of fires within this defensive perimeter. A computer based controller is used to monitor the water level in a storage tank and to control activation of a plurality of water delivery systems that function to apply water to the surrounding vegetation, the roof of the structure, the walls of the structure and any other site-specific locations that are required to prevent the ignition of a fire in this defensive perimeter. The water is preemptively applied to various combustible materials located within this defensive perimeter prior to the arrival of the fire in order to prevent these combustible materials contained from igniting due to burning embers that are wind-borne from the approaching fire. Therefore, this apparatus reduces the susceptibility of all combustible elements within the defensive perimeter to ignition to significantly decrease the fire danger to the residence and the surrounding vegetation. The computer based controller monitors water supply, wind velocity, locus and direction of the fire to sequentially and periodically activate various water delivery systems to maximize the protection effectiveness of the limited water resources that are available to the homeowner in the wildland/urban interface. This apparatus also includes a water recovery system in order to reuse the water that is applied to the roof and walls of the structure to reduce the need for water from the limited water supply. A manual access panel is also optionally provided so the system can be operated by homeowner, fire department personnel, police, etc. The computer provides all pertinent system information to operator so the panel can be used to modify system parameters or control activation of the system. This system can also be activated by homeowner from a remote location by means of a touch-tone phone connection to a telephone access port on the computer.

DETAILED DESCRIPTION

There is an increased incidence of home building in the area defined as the wildland/urban interface. This area is where residences are built in close proximity to the flammable fuels naturally found in wildland areas, including forests, prairies, hillsides and valleys. These areas typically represent the confluence of a plurality of factors that render firefighting difficult, if not impossible. The primary factor is combustible vegetation which is found in abundance in these areas. An approaching fire ignites the surrounding vegetation in a step by step attack on a home and may reach intensities that render conventional firefighting methods ineffectual. In particular, when the fire reaches an intensity of 500 btu per foot of fire line front per second of burning, the fire is considered to be beyond control by use of organized means. Beyond 1000 btu per foot per second a fire can be expected to feature dangerous spotting, fire whirls, crowning and major runs with high rates of spread and violent fire behavior. Spotting is particularly difficult to deal with since it occurs as wind borne burning embers are carried far ahead of the main fire front. These embers land in receptive fuels and can fall on the roofs of homes or woodpiles and start new fires far in advance of the fire line front.

In addition, many of the structures built in these rural areas are constructed of materials that are highly susceptible to fires. Primary among these are untreated wood roofs such as untreated wood shingles or wood shake roofing. Furthermore, these structures have combustible exterior walls or affiliated wood structures such as decks and woodpiles located under decks or placed too close to the structure. Many of the structures are located on a slope which creates a natural windflow that increases the speed of a wildfire by creating a chimney effect. The remote location of these structures impedes the ability of fire protection equipment to reach the site of a fire. Finally, there is typically a significant lack of water available for firefighting purposes. There are no hydrants or ponds and a fire tanker truck must respond to the site of the fire in order to provide a source of water for firefighting purposes. These structures typically have a domestic water supply that consists of a well of limited volumetric capacity. Therefore, the confluence of many or all of these factors make firefighting in this environment difficult at best.

System Architecture

Figure 1:
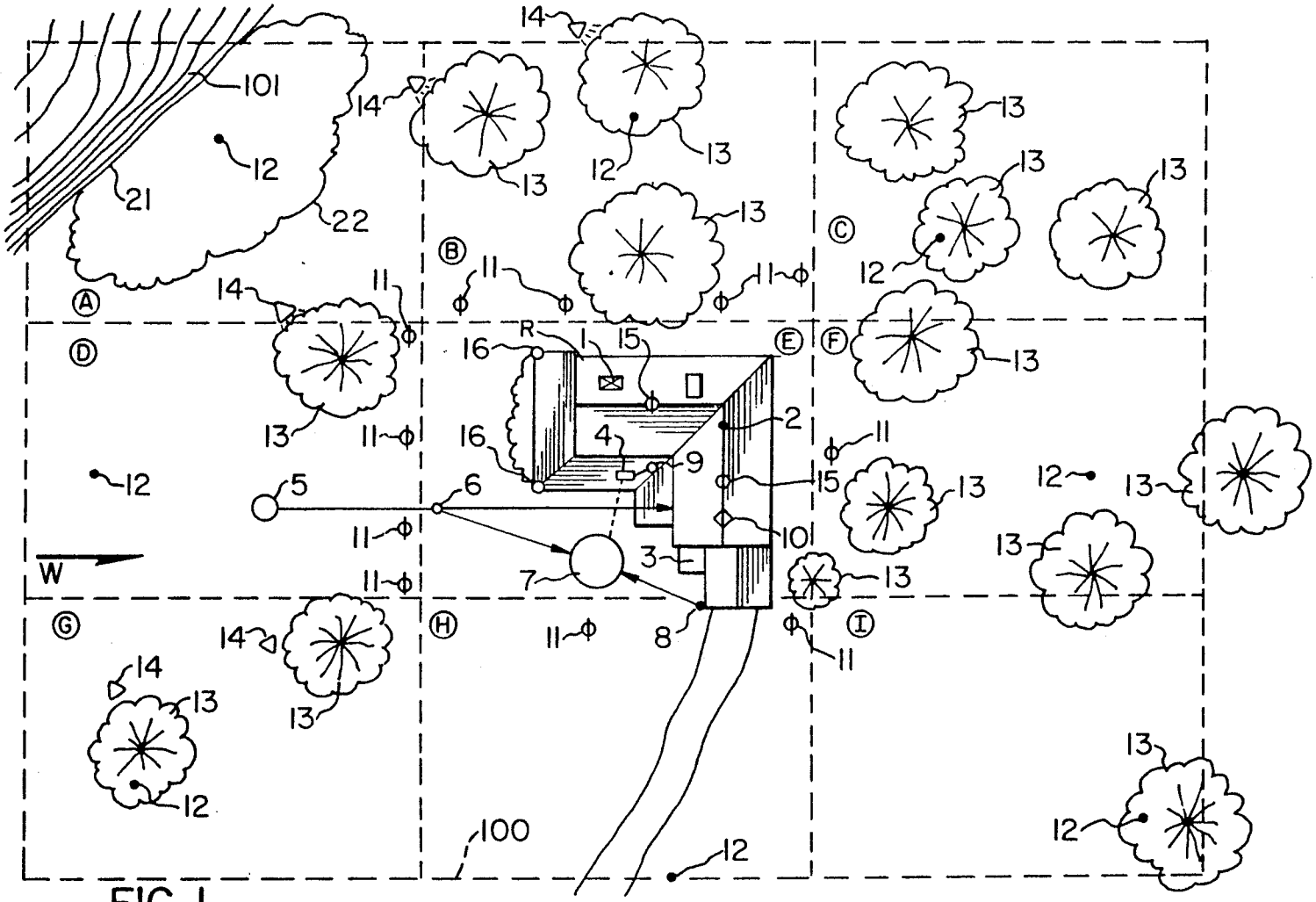
FIG. 1 illustrates an overview of a typical site in the wildland/urban interface area indicative of the structures contained therein and the primary elements of the apparatus of this fire protection system.
Figure 2:
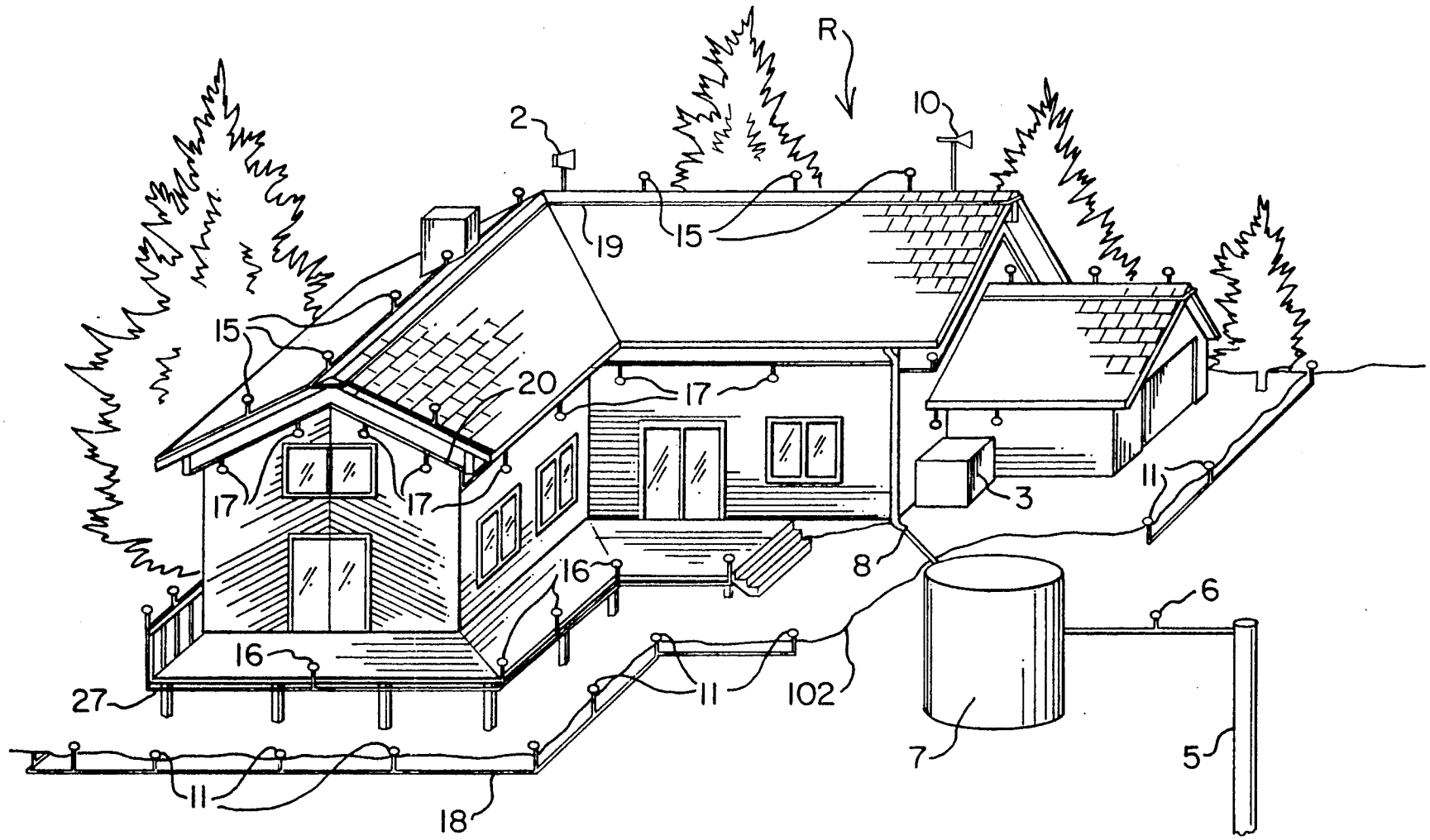
FIG. 2 illustrates in block diagram form a number of the primary architectural features of this apparatus.

FIGS. 1 and 2 illustrate a typical residential structure located in a wildland/urban interface zone. FIG. 1 illustrates an aerial view of the residence R and its surroundings, while FIG. 2 illustrates a side perspective view thereof. In order to simplify FIGS. 1 and 2, the pipes interconnecting many of the water delivery systems are not shown, nor are the electrical conductors that connect the computer 1 to the various sensors, control valves, etc. A limited number of sprinklers are shown in these drawings to clearly illustrate the concepts of this invention and it is understood that the number, placement and interconnection of these elements are highly site-specific and variable.

In FIG. 1, the residence R and its surroundings are encircled by a defensive perimeter 100 which is divided into a plurality of sectors (labeled A–I), each which represents a position of the defensive zone for fire protection purposes. While these sectors A–I are drawn in a rectilinear manner on FIG. 1, it is obvious that these can be arbitrarily shaped sectors and are selected as a function of the topology of the surrounding land, the vegetation present on the land and the particular characteristics of the residence and its outlying structures. For the sake of simplicity, the sectors A–I are drawn as square boxes on FIG. 1. The residence R and its immediate surroundings are located in sector E, which sector is completely surrounded by peripheral defensive sectors A–D, F–I which extend outwardly from sector E. Sector A includes in the upper lefthand corner thereof a steep slope 21 that descends away from the residence and represents a significant wildfire threat if a fire should initiate at the base of incline 21. Furthermore, dense shrubs are located at the top of incline 21 and serve to intensify the fire danger. Each of the sectors A–I illustrated in FIG. 1 includes at least one remote sensor 12 that senses the immediate presence of an ignited fire. These are heat sensors of conventional design and provide data to a centralized computer 1 which is located within the residence R to indicate that the fire has entered one of the sectors of the defensive perimeter A–D, F–I outlying the residential sector E.

System Architecture—Water Application Apparatus

FIG. 2 illustrates a side view of residential structure R, including a below grade 102 view of the pipes 18 that supply sprinklers 11 with water. Included in the fire deterrent apparatus is a holding tank 7 that stores a large quantity of fire retardant fluid that is used by this system to proactively prevent the ignition and spread of fire in the defensive sectors and on the structure illustrated herein. Holding tank 7 is supplied by a water source 5 which typically is a domestic well but which also can be supplemented by a pond, swimming pool or any other reservoir nearby. Diversion valve 6 interconnects water source 5 with holding tank 7 and is electrically activated by computer 1 to maintain a predetermined level of fluid within holding tank 7. Similarly, a recovery valve 8 is provided in order to recycle any water that is applied to the residential structure R back to holding tank 7 in order to minimize the requirement for supplemental water from the water source 5, which has a limited volumetric output. Recovery valve 8 is connected to a series of recovery pipes which can be as simple as interconnecting the downspouts from the existing house gutter system with recovery valve 8 in order to recycle any water that is applied to the roof of the structure R. The water recovery system can also include open troughs at the bottom of the walls in order to capture any water that is sprayed on the side of the structure R for recycling to recovery valve 8 into holding tank 7. A supplemental source of power such as generator 3 is provided to guarantee a source of electricity to operate the valves, water pumps, computer system sensors, and generator 3 is activated in the event that there is a loss of power from the utility company.

A fire detection sensor 2 is used by the system in order to sense the presence of a wildfire in the region around the structure and its defensive perimeter. The sensor is typically an infrared, electro-optical or ultraviolet sensor 2 mounted on the peak of the roof and has an omni directional (360°) sensing capability that detects the presence of a fire up to 1 kilometer away from its location. In addition, an anemometer 10 is provided in order to identify the ambient wind velocity which affects the spread of the fire and the strategy of fire prevention that this system needs to implement. The apparatus used to preemptively defend against the spread of wildfire includes a plurality of sprinklers 11 that are strategically placed to spray the vegetation surrounding the structure R with a fire retardant fluid (such as water) in order to impede the spread of the fire. Sprinklers 14 also can be optionally included to spray the trees 13 in order to prevent airborne embers from igniting this particular vegetation. Trees are susceptible to the intense radiation caused by an approaching wildfire and application of water to the trees, especially in drought conditions, significantly deters the spread of radiant ignited fires. Sprinklers 15, 17 are also included on the roof and walls of the structure R and sprinklers 16 are preferably mounted on the outlying annexes thereto such as decks in order to direct a spray of the fire retardant fluid on the roof and walls of the structure R as well as its decks, wooden walkways, shrubbery, etc. The various sprinklers 11, 14–17 are supplied with water from pressure tank 9 via supply pipes 18–20, 24 only a few of which are shown. It should also be noted that the term "sprinkler" is understood to include all types of apparatus that would apply water to an object in a manner, volume, area desirable for the stated purpose including seeper hoses, etc.

This fire deterrent apparatus operates in a proactive manner with a knowledge based system in order to apply the limited fire retardant resources in the most beneficial manner to the structure R and its surrounding vegetation to impede the progress of an approaching fire. The use of a plurality of sectors A–I within the predetermined defensive perimeter 100 enables the computer system to maximize the application of the fire retardant fluid on the surrounding vegetation and on the structure R in the sector most directly in the path of the approaching fire. Depending on availability of fire retardant fluid in holding tank 7, the ambient wind conditions, and speed of approaching fire, computer system 1 can focus all of the fire prevention measures into a predetermined sector or may activate fire prevention measures in a plurality of the sectors, with a different intensity in each sector depending on the nearness of the sector to the approaching fire. In this manner, weighted or site-specific fire prevention measures are initiated on a sector by sector basis.

Operational Program—Fire Detection

Figure 3:
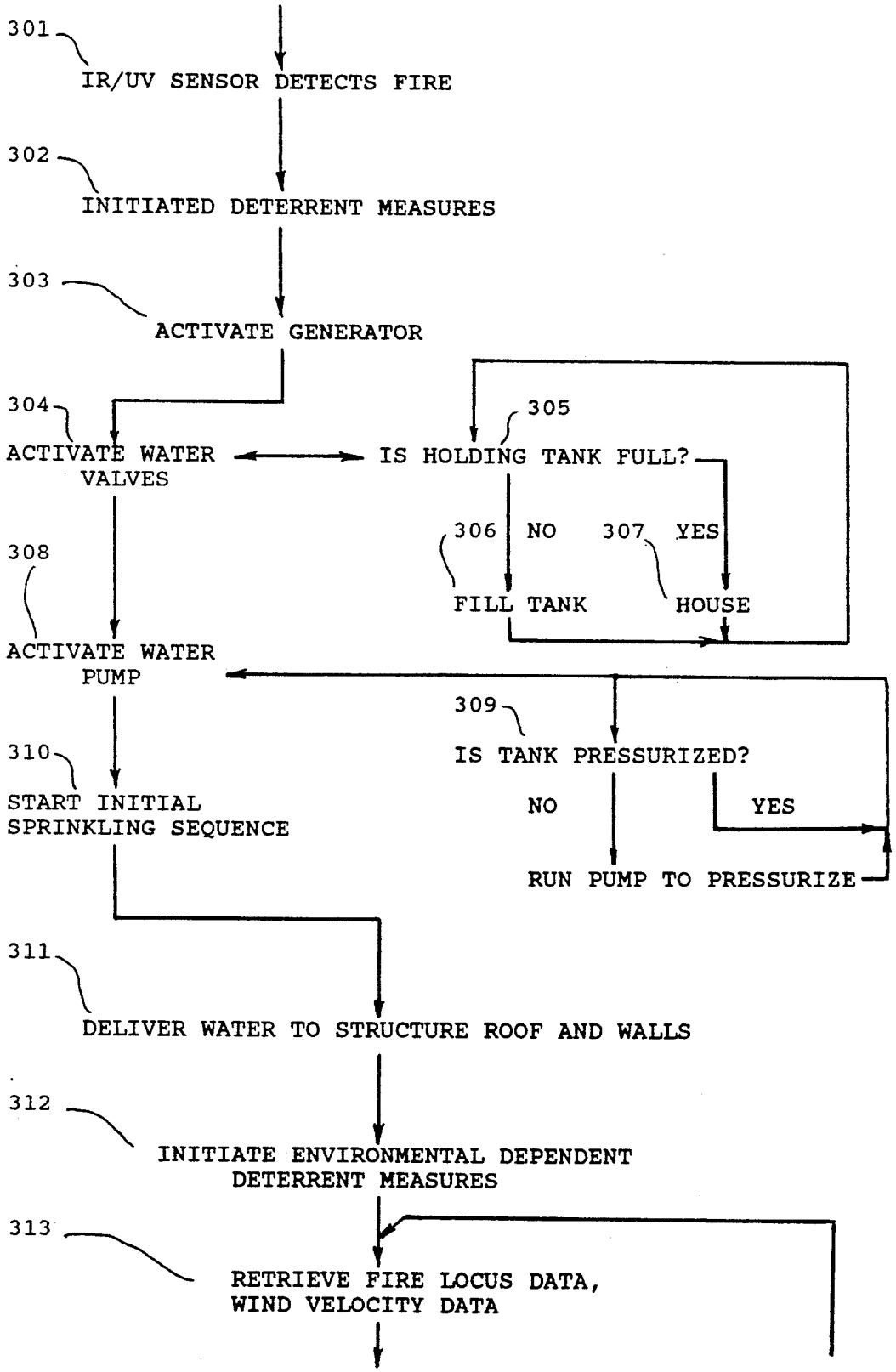
FIGS. 3–5 illustrate in flow diagram form the operational steps taken by the controller in this apparatus to defend the residence from an impending wildfire.
Figure 4:
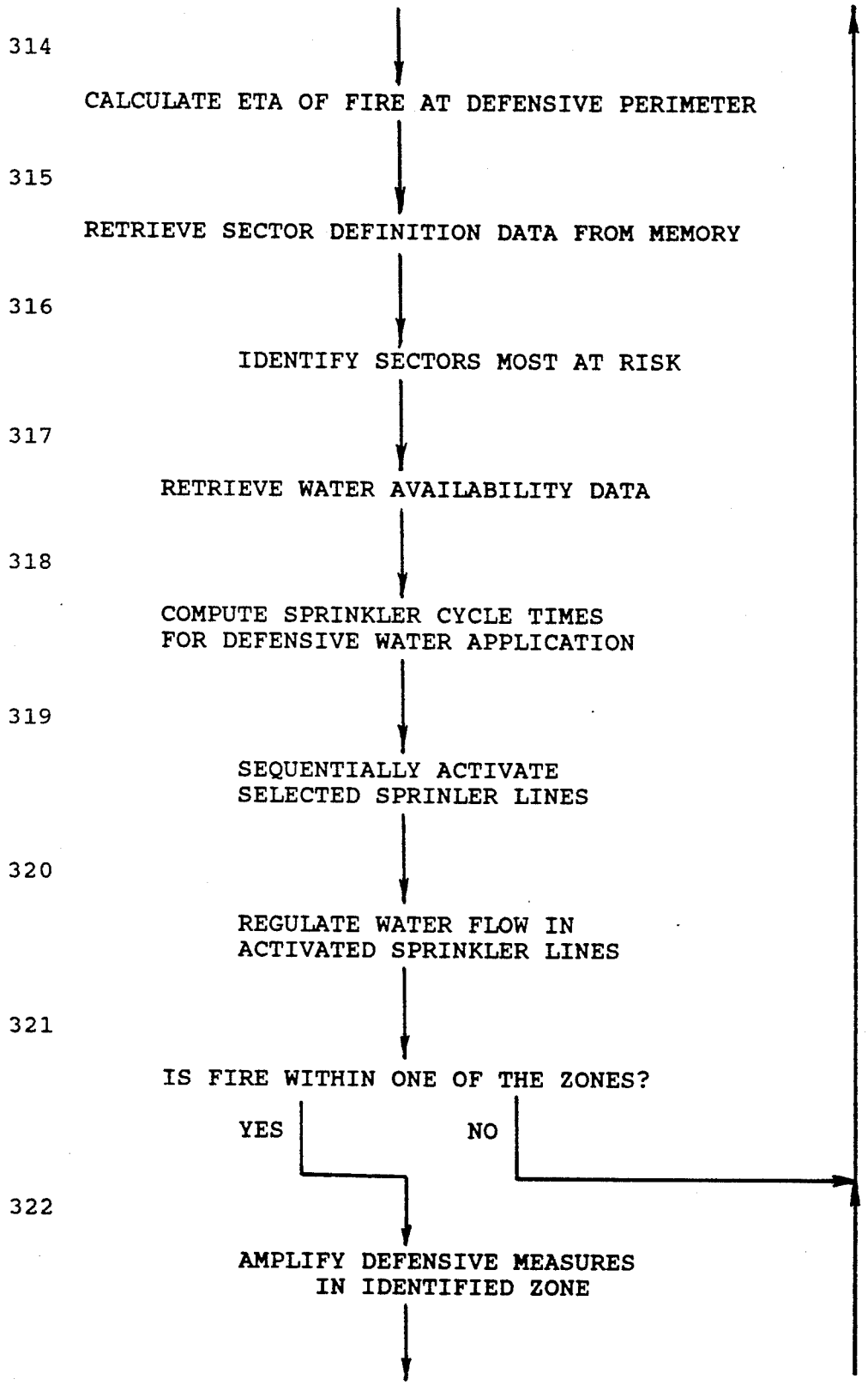
Figure 5:
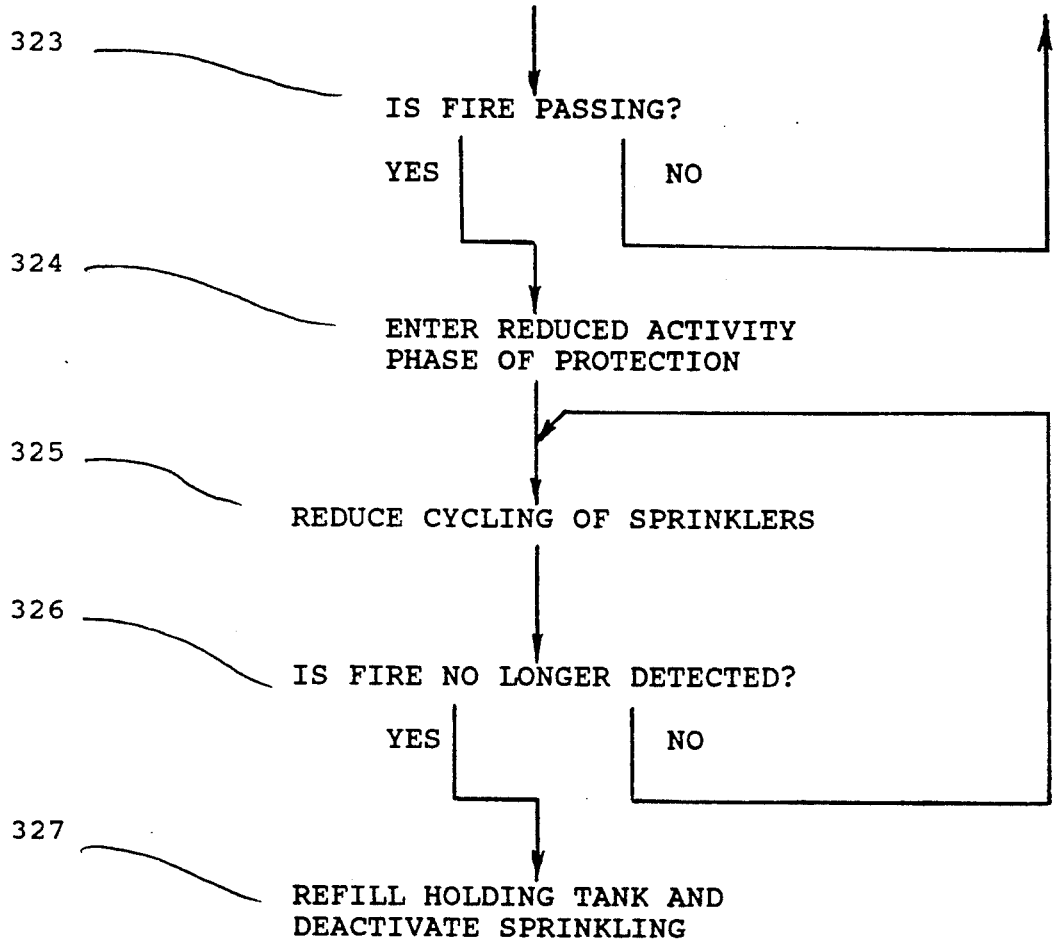

FIGS. 3–5 illustrate in flow diagram form the primary operational steps taken by the fire prevention program resident on computer system 1 in order to controllably activate the various sprinklers 11, 14–17, pumps 4, generators 3 and other apparatus that comprise this system. At step 301, sensor 2 detects the presence of a wildfire within the vicinity of the structure R to be defended. Sensor 2 operates on an interrupt basis causing the computer system 1 to initiate the deterrent portion of the defensive program at step 302. Alternatively, the computer system 1 can be activated by a user via a telephone dial up port on computer system 1 or via a manual access panel which can be located on the exterior of structure R to enable firefighting personnel to activate the system. At step 303, the electrical generator 3 (if provided) is activated to ensure a constant source of power for the fire deterrent apparatus. At step 304, the water valves 6, 8 are activated and data is received from one of the continuously running programs resident on computer system 1. One continuously running program is the holding tank maintenance program that at step 305 determines whether the holding tank 7 is full of water. If not, diversion valve 6 is activated at step 306 to fill holding tank 7 with water up to its maximum level. Once holding tank 7 is full, processing proceeds to step 307 where diversion valve 6 is switched to its normal position to supply water to the domestic plumbing. At step 304 the structure defensive sequence is activated and the fluid recovery valve 8 is switched to recycle the water from the roof and walls of the structure R into the holding tank 7. At step 308 the water pump 4 is activated to provide a pressure boost above that level of pressure supplied by a residential water pump to pressurize pressure tank 9. At step 309 another continuous loop program is illustrated wherein it is determined whether the pressure tank 9 is fully pressurized. This continuous loop consisting of steps 309 and 308 operate to cycle the water pump 4 to maintain a minimum pressure in the pressure tank 9 in order to provide water to all of the sprinklers 11 at the required pressure.

There are a significant number of philosophical approaches to defending the structure R illustrated in FIGS. 1 and 2 from the impending wildfire. The philosophy illustrated herein is to immediately and at all times provide the maximum protection possible for the structure R itself with the sector defenses being activated concurrently therewith in an ordered sequence. It is possible to activate the sector defenses initially and to subsequently, upon the closer arrival of the impending fire, activate the structure defenses. This is arguably a more risky strategy but is philosophically within the purview of this apparatus and is left up to the structure owner to select the particular defensive sequence that is most applicable to the site-specific factors surrounding the structure.

Initial Fire Deterrent Measures

For the sake of illustration, assume that a wildfire W is approaching sector D as illustrated by the arrow on FIG. 1. At step 310, the initial sprinkling sequence is activated. At step 311 a timing cycle is provided to ensure that the structure R is sprinkled by the plurality of sprinklers 15–17 on or about the structure for a predetermined time interval. This predetermined time interval is a function of the types of materials which are used to build the structure R and the amount of water within holding tank 7 that can be allocated for an initial sprinkling sequence. These are preset parameters that are typically programmed into the system by the owner of the structure R. The various sprinkling systems 15–17 are typically activated in segments to reduce the required volumetric flow required of water pump 5. The sequencing of the sprinkler lines is also performed on a priority basis with, for example, the roof being sprinkled prior to the walls.

While the sprinkling sequence is activated and operational, at step 312 the environmental dependent deterrent measure section of the computer program is activated and at step 313 a fire movement subroutine is activated which polls the anemometer 10 and sensor 2 to determine the locus and velocity of the fire as well as the ambient wind conditions to calculate at step 314 the estimated time of arrival of the fire at the defensive perimeter. This calculation also includes retrieving at step 315 from memory in computer system 1 the definition of the plurality of sectors A–I therefrom to map the fire movement onto sector specific locations in order to identify at step 316 the sectors D which are most likely to be the initial contact with the approaching wildfire. Using the sector specific estimated time of arrival computation, and the water availability data retrieved at step 317, the system determines at step 318 a timed sprinkling sequence which can be weighted on a sector specific basis. A preferred operational sequence is to lightly spray all the vegetation using sprinklers 11, A distributed in the peripheral defensive sectors in order to lightly dampen these combustible materials. At step 317, the level of water in the holding tank 7 was measured and a calculation made as to the availability of water that can be used for supplemental flow in the sectors A, D, G nearest the approaching fire. If sufficient water is available to periodically sprinkle the structure R as well as continue vegetation sprinkling in at least one of the outlying sectors, the sprinklers 11, 14 in the sector D nearest the approaching fire W are activated at step 319 in order to further soak the vegetation in that sector D. Again, as a function of the quantity of water available in holding tank 7, adjacent sectors A; G may also have sprinklers 11, 14 activated therein, possibly at a lower flow level (step 320) than the sector D closest to the approaching wildfire W. An example is to sprinkle for five minutes on with a five minute interval between sprinkler initiations. Once the sprinkling cycles have been activated, the computer system 1 continually monitors the distance away from the structure and the velocity of approach of the fire W.

Fire Within Defensive Perimeter

If any of the local heat sensors 12 are triggered at step 321, indicating the presence of a fire within one of the sectors A–I, the computer program immediately activates sprinklers 11, 14 adjacent to the triggered remote sensors 12 in order to extinguish these localized fires. It is typical in a wildfire situation to have airborne embers ignite vegetation in a condition that is called spotting wherein the embers begin localized fires that, if extinguished at an early stage, do not pose a significant threat to the structure R. Therefore, computer program 1 at step 322 maximizes operational flows of water from water source 5 into holding tank 7 and through recovery valve 8 into holding tank 7. The operational pressure of the water in the lines to sprinklers 11, 14 are maximized by typically interspersing the activation of various sprinkler lines in order to minimize the flow demand on the water supply system. A typical system can not drive all sprinkler heads 11, 14–17 concurrently but can cycle various patterns of sprinkler heads on a time shared basis. Sets of sprinkler heads 11, 14 are plumbed together on a sector by sector basis and may also be orchestrated as a function of the type of vegetation to be sprayed. One set of sprinklers 14 can be used to spray trees and shrubs while another set of sprinklers 11 can be used to spray grassy areas and a third set of sprinklers 15, 16, 17 can be used to spray outlying structures or the main structure 17 itself.

Fire Passing Defensive Perimeter

As the fire approaches the structure R, the computer program, using the input from the ultraviolet sensor 2 as well as from the remote sensors 12, determines when the fire has ceased to approach the structure R. At step 323 the computer program determines whether the wildfire W is passing away from the defensive perimeter and de-escalates the fire activity at step 324 as a function of the nearness of approach and departure of the fire danger. Even though the fire may have ceased approaching, as long as it is within a predetermined distance from the structure it represents a threat to the structure R due to the feature of spotting or potential shifts in wind direction. Therefore, even though the fire may be retreating from the structure R, the computer system 1 continues a periodic wetting of the structure R and the surrounding vegetation in a reasonable cycle as a function of the amount of water available in holding tank 7. The frequency of sprinkling can be decreased at step 325 if the holding tank 7 is unable to maintain a significant quantity of water therein and also as a function changes in the wind magnitude and velocity and the nearness of the fire. When sensor 2 no longer senses the presence of a fire at step 326, the program advances to step 327 where holding tank 7 is refilled and all sprinkling is deactivated. Once the holding tank 7 is filled, the system returns to its prefire state.

In the manner outlined above, it can be seen that the system of the present invention provides an intelligent method of fire prevention by detecting the presence of a fire before it becomes an immediate threat to the structure and proactively applying defensive measures thereto. This minimizes the susceptibility of the structure's flammable materials and the surrounding vegetation to ignition by the wildfire. All prior art systems extinguish fires once they occur but do nothing to prevent the initiation of the fire. Therefore, these prior art firefighting methods are ineffectual in a wildfire environment since the intensity of the wildfire immediately overwhelms any defensive measure that can be installed on a structure given the typical conditions in the wildland/urban interface. In fact, once a wildfire ignites a structure in the wildland/urban interface it is generally impossible to extinguish the blaze in most wildfire conditions since the intensity of the fire thwarts reasonable firefighting activity unless a significant volume of water is available and a number of pieces of firefighting equipment are present before the fire has completely engulfed the structure.

While a specific embodiment of this invention has been disclosed, it is expected that those skilled in the art can and will design alternate embodiments of this invention that fall within the scope of the appended claims.

We claim:

1. Apparatus for defending a predetermined area containing combustible materials from fire, comprising:

automated means, located in said predetermined area, for generating a signal indicative of the presence of a fire located exterior to and remote from said predetermined area;

automated means, responsive to said generated signal, for determining an estimated time of arrival of said fire at said predetermined area; and automated means for activating fire retardant measures within said predetermined area a predetermined time in advance of said calculated time of arrival of said fire.

2. The apparatus of claim 1 wherein said activating means includes:

means, responsive to a detected approaching fire, for dispensing a fire retardant fluid on to said combustible materials in said predetermined areas.

3. The apparatus of claim 1 further comprising:

memory means for storing data defining a plurality of sectors within said predetermined area;

means, responsive to a detected approaching fire, for identifying at least one of said sectors most likely to be in a path of said approaching fire;

a plurality of means in each of said sectors for applying said fire retardant fluid on vegetation; and wherein said activating means further includes:

means for differentially enabling said plurality of applying means as a function of said identified sector.

4. The apparatus of claim 3 further comprising:

means in each of said sectors for detecting the immediate presence of said fire within said sector.

5. The apparatus of claim 4 further comprising:

means, responsive to at least one of said detecting means indicating the immediate presence of said fire, for amplifying said fire retardant measures in said sector in which said at least one detecting means is located.

6. The apparatus of claim 4 further comprising:

memory means for storing data defining a defensive zone extending a predetermined distance from at least one structure within said predetermined area and including land that encircles said structure;

means, responsive to at least one of said detecting means indicating the immediate presence of said fire at said defensive zone, for executing fire retardant measures on said structure.

7. The apparatus of claim 3 wherein said determining means includes;

means for measuring magnitude and direction of wind within said predetermined area; and means, responsive to said sensing means identifying a locus of said fire, for computing a velocity of said fire indicative of direction and speed of movement of said fire.

8. The apparatus of claim 7 wherein said identifying means includes:

means for retrieving said stored data from said memory means; and means for mapping said locus and velocity of said fire onto said defined set of sectors.

9. The apparatus of claim 6 wherein said activating means includes:

means for storing fire retardant fluid;

means for dispensing said fire retardant fluid onto said structure; and means for applying said fire retardant fluid on vegetation surrounding said structure.

10. The apparatus of claim 9 wherein said activating means further includes:

means for periodically enabling said dispensing means and said applying means;

11. The apparatus of claim 9 wherein said activating means further includes:

means for recovering said fire retardant fluid dispensed onto said structure for return to said storing means.

12. The apparatus of claim 9 wherein said activating means further includes:

means for diverting water from a domestic water source to said storing means.

13. The apparatus of claim 9 wherein said activating means further includes:

means for measuring the volume of said fire retardant fluid in said storing means; and means for regulating the operation of said dispensing means and said applying means as a function of said measured volume.

14. The apparatus of claim 1 further comprising:

means for providing a source of electrical power independent of utility company power that is connected to said structure.

15. The apparatus of claim 1 further comprising:

means for enabling a user to input data into said apparatus to regulate the operation thereof.

16. A method for controlling fire deterrent apparatus to defend a predetermined area containing combustible materials from fire, comprising the steps of:

automatically sensing the presence of a fire located exterior to and remote from said predetermined area;

automatically determining an estimated time of arrival of said fire at said predetermined area; and automatically activating fire retardant measures within said predetermined area a predetermined time in advance of said calculated time of arrival of said fire.

17. The method of claim 16 wherein said step of activating includes:

dispensing, in response to a detected approaching fire, a fire retardant fluid on to said combustible materials within said predetermined area.

18. The method of claim 16, wherein said predetermined area is divided into a plurality of sectors, each of which includes a plurality of apparatus for applying said fire retardant fluid on vegetation, data defining said sectors being stored in a memory, further comprising the steps of:

identifying, in response to a detected approaching fire, at least one of said sectors most likely to be in a path of said approaching fire; and wherein said step of activating further includes:

differentially enabling said plurality of applying means as a function of said identified sector.

19. The method of claim 18 further comprising the step of:

detecting in each of said sectors the immediate presence of said fire within said sector.

20. The method of claim 19 further comprising the step of:

amplifying, in response to a detected immediate presence of said fire, said fire retardant measures in said sector in which said detected fire is located.

21. The method of claim 19, wherein said fire deterrent apparatus includes a memory for storing data defining a defensive zone extending a predetermined distance from at least one structure within said predetermined area and including land that encircles said structure, further comprising the step of:

executing, in response to the detected immediate presence of said fire within said defensive zone, fire retardant measures on said structure.

22. The method of claim 18 wherein said step of determining includes:

measuring magnitude and direction of wind within said predetermined area; and computing, in response to said identified locus of said fire, a velocity of said fire indicative of direction and speed of movement of said fire.

23. The method of claim 22 wherein said step of identifying includes:

retrieving said stored data from said memory means; and mapping said locus and velocity of said fire on to said defined set of sectors.

24. The method of claim 16 wherein said step of activating includes:

storing fire retardant fluid in a holding tank;

dispensing said fire retardant fluid onto said structure; and applying said fire retardant fluid on vegetation surrounding said structure;

25. The method of claim 24 wherein said step of activating further includes:

periodically enabling said steps of dispensing and applying.

26. The method of claim 24 wherein said step of activating further includes:

recovering said fire retardant fluid dispensed on to said structure for return to said holding tank.

27. The method of claim 16 wherein said step of activating further includes:

diverting water from a domestic water source to said holding tank.

28. The method of claim 16 wherein said step of activating further includes:

measuring the volume of said fire retardant fluid in said holding tank; and regulating the operation of said dispensing and applying steps as a function of said measured volume.

29. The method of claim 16 further comprising the step of:

providing a source of electrical power independent of utility company power independent of utility company power that is connected to said structure.

30. Apparatus for defending a structure from fire, comprising:

memory means for storing data defining a defensive zone extending a predetermined distance from said structure and including land that encircles said structure, wherein said defensive zone is divided into a plurality of sectors;

automated means, located in said defensive zone, for sensing the presence of a fire located exterior to and remote from said defensive zone;

automated means, responsive to a detected approaching fire, for identifying at least one of said sectors most likely to be in a path of said approaching fire;

automated means for determining an estimated time of arrival of said fire at said defensive zone;

automated means for activating fire retardant measures within said defensive zone a predetermined time in advance of said calculated time of arrival of said fire, including:

means for storing fire retardant fluid;

means for dispensing said fire retardant fluid onto said structure;

a plurality of means in each of said sectors for applying said fire retardant fluid on combustible materials located in said sector; and means for differentially enabling said plurality of applying means as a function of said identified sector.

31. The apparatus of claim 30 wherein said activating means further includes:

means for periodically enabling said dispensing means and said applying means.

32. The apparatus of claim 30 further comprising:

means in each of said sectors for detecting the immediate presence of said fire within said sector; and means, responsive to at least one of said detecting means indicating the immediate presence of said fire, for amplifying said fire retardant measures in said sector in which said at least one detecting means is located.

33. The apparatus of claim 30 wherein said determining means includes:

means for measuring magnitude and direction of wind within said defensive zone;

means, responsive to said sensing means identifying a locus of said fire, for computing a velocity of said fire indicative of direction and speed of movement of said fire;

means for retrieving said stored data from said memory means; and means for mapping said locus and velocity of said fire onto said defined set of sectors comprising said defensive zone.

34. The apparatus of claim 30 wherein said activating means further includes:

means for diverting water from a domestic water source to said storing means.

35. The apparatus of claim 30 wherein said activating means further includes:

means for measuring the volume of said fire retardant fluid in said storing means; and means for regulating the operation of said dispensing means and said applying means as a function of said measured volume.

36. The apparatus of claim 30 further comprising:

means for providing a source of electrical power independent of utility company power that is connected to said structure.

37. The apparatus of claim 30 further comprising:

means for enabling a user to input data into said apparatus to regulate the operation thereof.

38. The method for defending a structure from fire, comprising the steps of:

storing data defining a defensive zone extending a predetermined distance from said structure and including land that encircles said structure, wherein said defensive zone is divided into a plurality of sectors;

automatically sensing the presence of a fire located exterior to and remote from said defensive zone;

automatically identifying, in response to a detected approaching fire, at least one of said sectors most likely to be in a path of said approaching fire;

automatically determining an estimated time of arrival of said fire at said defensive zone;

automatically activating fire retardant measures within said defensive zone a predetermined time in advance of said calculated time of arrival of said fire, including:

storing fire retardant fluid in a holding tank;

dispensing said fire retardant fluid onto said structure;

wherein each of said sectors includes a plurality of means for applying said fire retardant fluid on combustible materials located in said sector; and differentially enabling said plurality of applying means as a function of said identified sector.

39. The method of claim 38 wherein said step of activating further includes:

periodically enabling said step of dispensing and said applying means.

40. The method of claim 39 further comprising the steps of:

detecting the immediate presence of said fire within each of said sectors; and amplifying, in response to a detected immediate fire, for amplifying said fire retardant measures in said sector in which said fire is detected.

41. The method of claim 38 wherein said step of determining includes:

measuring magnitude and direction of wind within said defensive zone;

computing a velocity of said fire indicative of direction and speed of movement of said fire;

retrieving said stored sector data; and mapping said locus and velocity of said fire onto said defined set of sectors comprising said defensive zone.

42. The method of claim 38 wherein said step of activating further includes:

diverting water from a domestic water source to said holding tank.

43. The method of claim 38 wherein said step of activating further includes:

measuring the volume of said fire retardant fluid in said holding tank; and regulating the operation of said dispensing and said applying steps as a function of said measured volume.

44. The method of claim 38 further comprising the step of:

providing a source of electrical power independent of utility company power that is connected to said structure.

* * * * *